US006997145B2

(12) United States Patent
Adams

(10) Patent No.: US 6,997,145 B2
(45) Date of Patent: Feb. 14, 2006

(54) RECYCLER FOR LINEAR MOTOR

(76) Inventor: Joseph S. Adams, 481 Beaver Point Road, Salt Spring Island, British Columbia (CA) V8K 2J9

( * ) Notice: Subject to any disclaimer, the term of this patent is extended or adjusted under 35 U.S.C. 154(b) by 0 days.

(21) Appl. No.: 11/058,683

(22) Filed: Feb. 15, 2005

(65) Prior Publication Data

US 2005/0145206 A1 Jul. 7, 2005

Related U.S. Application Data

(63) Continuation of application No. 10/341,745, filed on Jan. 14, 2003, now Pat. No. 6,874,452.

(60) Provisional application No. 60/349,293, filed on Jan. 15, 2002.

(51) Int. Cl.
*F02B 19/02* (2006.01)

(52) U.S. Cl. ..... 123/46 R; 123/260

(58) Field of Classification Search ..... 123/46 R, 123/46 A, 260, 268, 283, 286, 253
See application file for complete search history.

(56) References Cited

U.S. PATENT DOCUMENTS

| | | | | |
|---|---|---|---|---|
| 2,886,024 A | | 5/1959 | Elias | |
| 3,314,403 A | * | 4/1967 | Bouvier et al. | 123/46 R |
| 3,363,661 A | | 1/1968 | Horton | |
| 3,610,215 A | * | 10/1971 | Carter | 123/46 SC |
| 3,809,022 A | | 5/1974 | Dean, Jr. | |
| 3,898,965 A | | 8/1975 | Fischer | |
| 3,934,560 A | | 1/1976 | Dodd | |
| 3,983,858 A | | 10/1976 | Sevald | |
| 4,332,224 A | | 6/1982 | Latsch et al. | |
| 4,559,911 A | | 12/1985 | Bodine | |
| 4,665,868 A | * | 5/1987 | Adams | 123/46 SC |
| 4,759,318 A | | 7/1988 | Adams | |
| 4,894,005 A | | 1/1990 | Keller | |
| 5,197,434 A | | 3/1993 | Contreras Orellana | |
| 5,269,280 A | * | 12/1993 | Braun et al. | 123/527 |
| 5,377,628 A | | 1/1995 | Adams | |
| 5,540,194 A | | 7/1996 | Adams | |
| 5,715,787 A | | 2/1998 | Kawamura | |
| 5,983,624 A | | 11/1999 | Anderson | |
| 6,098,588 A | | 8/2000 | Hufnagel | |

(Continued)

FOREIGN PATENT DOCUMENTS

DE 42 43 617 A1 12/1992

(Continued)

*Primary Examiner*—Henry C. Yuen
*Assistant Examiner*—Jason Benton
(74) *Attorney, Agent, or Firm*—Thomas B. Ryan; Stephen B. Salai, Esq.; Harter, Secrest & Emery, LLP

(57) ABSTRACT

A recycling system for linear motors includes a dual piston within a cylinder housing that is moved from an upper position to a lower position by combustion pressure such that a first portion of the piston pumps compressed air from a first air chamber within a first bore of the cylinder housing and a second portion of the piston pumps compressed air from a second air chamber within a second larger bore of the cylinder housing. An exhaust valve is opened by the compressed air for venting the combustion chamber to atmosphere. The dual piston moves within the cylinder housing from the lower position to the upper position assisted by the compressed air such that a portion of the volume of the combustion chamber is converted into a portion of the volume of the second air chamber. A control valve is opened in response to movement of the dual piston through the upper position for allowing airflow from the second air chamber into the combustion chamber.

26 Claims, 10 Drawing Sheets

U.S. PATENT DOCUMENTS 6,135,069 A * 10/2000 Fenelon et al. ..... 123/46 R
6,205,961 B1 * 3/2001 Bailey et al. ..... 123/46 R
6,213,097 B1 4/2001 Maucher
6,430,919 B1 8/2002 Duncan
6,460,507 B1 * 10/2002 Thieleke et al. ..... 123/260
6,491,002 B1 12/2002 Adams
6,634,325 B1 10/2003 Adams
6,647,969 B1 11/2003 Adams
6,840,033 B1 1/2005 Adams
6,874,452 B1 * 4/2005 Adams ..... 123/46 R

FOREIGN PATENT DOCUMENTS

EP 0 595 473 B1 12/1997

* cited by examiner

RECYCLER FOR LINEAR MOTOR

CROSS-REFERENCE TO RELATED APPLICATIONS

This application is a continuation of application Ser. No. 10/341,745 filed on Jan. 14, 2003 now U.S. Pat. No. 6,874,452, which claims the benefit of U.S. Provisional Application No. 60/349,293, filed on Jan. 15, 2002, both of which applications are incorporated by reference herein.

FIELD OF THE INVENTION

Spark-ignition combustion-powered linear motors provide onboard power for portable power tools and other devices such as nail guns, staplers, and other fastener driving tools.

DESCRIPTION OF RELATED ART

Typical spark-ignition linear motors of portable power tools operate at or near atmospheric pressure prior to ignition. A mixture of fuel and air is established in a combustion chamber and is ignited by a spark for combusting the mixture and driving a piston actuator of the tool. In order to achieve acceptable levels of efficiency from such motors, some sort of combustion accelerating device is added.

For example, a portion of the charge (i.e., the mix of fuel and air) is held in a pre-combustion (or primary combustion) chamber and is ignited to build sufficient pressure to spew flame jets into the main combustion (or secondary combustion) chamber. The flame jets turbulate and ignite the pre-established mix of fuel and air in the main combustion chamber.

My issued U.S. Pat. No. 6,840,033 entitled Combustion Chamber System, which is hereby incorporated by reference, discloses an elongated pre-combustion chamber within which an organized flame front propels a mix of unburned fuel and air through a check valve into the main combustion chamber. The delivery of additional fuel and air into the main combustion chamber increases pressure and generates turbulence in advance of the arrival of the flame front for producing a more robust combustion in the main combustion chamber.

Although increasing power output of spark-ignited linear motors, pre-combustion chambers can present a problem when the combustion chamber needs to be scavenged and the combusted gases replaced with a fresh fuel and air mix. The pre-combustion chamber needs to be opened to circulate scavenging air. Typically, the openings between pre-combustion and main combustion chambers are small to achieve acceptable flame jet velocities, and the scavenging air must pass through the same small openings. The restriction to scavenging and subsequent recharging flows can slow cycle times and reduce scavenging efficiency.

BRIEF SUMMARY OF THE INVENTION

My invention contemplates improvements to-scavenging efficiency and combustion efficiency. Accompanying the generation of an organized flame front within a combustion chamber is a faster moving compression wave. The combustion chamber can be arranged in accordance with my invention to exploit resonant properties of the compression wave for such purposes as compressing pre-established mixes of fuel and air and redirecting the flame front. A less restrictive scavenging path is possible for simplifying and enhancing scavenging and replenishing operations (i.e., recycling). Enhanced power output is possible by generating additional turbulence and compression within the combustion chamber.

One example of such a combustion chamber system for a combustion-powered linear motor includes a primary combustion chamber in communication with a secondary combustion chamber through a common opening. A spark igniter located within the primary combustion chamber generates a flame front and an accompanying faster moving compression wave. The primary combustion chamber is shaped for guiding the compression wave along a path through the opening between the primary and secondary combustion chambers in advance of the flame front. The primary combustion chamber is also shaped to support propagation of the flame front for propelling unburned fuel and air in advance of the propagating flame front. The secondary combustion chamber is shaped for reflecting the compression wave in a direction that compresses the unburned fuel and air propelled by the propagating flame front for enhancing combustion accompanying the discharge of the flame front into the secondary combustion chamber.

For purposes of enhancing scavenging and recharging operations, the opening between the primary and secondary combustion chambers is preferably an unrestricted opening. However, the unrestricted opening is preferably a first of two openings between the primary and secondary combustion chambers. The unrestricted opening allows the compression wave to reflect from the secondary combustion chamber back into the primary combustion chamber in a direction opposed to a direction of propagation of the flame front within the primary combustion chamber. A second smaller of the two openings is positioned to inject the flame front into the secondary combustion chamber accompanying a collision with the reflected compression wave with the flame front within the primary combustion chamber. Four equally spaced openings are preferred for this purpose to accelerate combustion throughout the secondary combustion chamber. Thus, the returning compression wave effectively closes the unrestricted opening during ignition and forces the flame front through the smaller opening for accelerating combustion within the secondary combustion chamber. Following combustion, the unrestricted opening supports a free flow of scavenging and recharging gases between the primary and secondary combustion chambers.

The primary and secondary combustion chambers are preferably arranged concentrically about a common axis. The primary combustion chamber preferably includes tubular sidewalls for guiding both the flame front and the compression wave along the common axis. The secondary combustion chamber preferably includes tubular sidewalls for guiding the compression wave along the common axis. In addition, the secondary combustion chamber preferably includes two parallel end faces for reflecting the compression wave between them along the common axis. A face of a piston that is driven by combustion in the secondary combustion chamber preferably forms one of the parallel end faces. The opening between the primary and secondary combustion chambers preferably extends normal to the common axis.

In one particular configuration, the primary combustion chamber is surrounded by the secondary combustion chamber throughout a common length along the common axis. An exhaust valve is preferably located in the primary combustion chamber. The opening is preferably unrestricted and a first of two openings. A second smaller of the two openings is located along the common axis between the exhaust valve and the unrestricted opening. Following combustion, a flow of air can be directed through the unrestricted opening into the primary combustion chamber before exiting through an exhaust valve for scavenging residual combustion products from the primary and secondary combustion chambers.

Combustion is preferably initiated in a spark-ignition combustion-powered motor in accordance with my invention by first establishing a mix of fuel and air in both a primary combustion chamber and a secondary combustion chamber. A flame front is ignited producing a faster compression wave. The flame front and the compression wave propagate at different speeds along the primary combustion chamber, the flame front propelling an unburned portion of the mix of fuel and air along the primary combustion chamber. The compression wave propagates through an opening into the secondary combustion chamber in advance of the flame front. Within the secondary combustion chamber, the compression wave is reflected on a return path that collides with the propagating flame front to accelerate combustion of the mix of fuel and air in the secondary combustion chamber at an elevated pressure.

The compression wave preferably propagates through an unrestricted opening between the primary and secondary combustion chambers. The reflected compression wave returns through the unrestricted opening and collides with the propagating flame front within the primary combustion chamber. The returning compression wave effectively closes the opening for compressing the unburned fuel and air in advance of the propagating flame front. The collision between the reflected compression wave and the propagating flame front forces a flame jet through one or more smaller openings between the primary and secondary combustion chambers for accelerating combustion of the mix of fuel and air in the secondary combustion chamber.

Preferably, the compression wave is reflected from opposite ends of the secondary combustion chamber to establish a desired resonance. The reflections from one of the opposite ends can be split between the primary and secondary combustion chambers. The split reflection provides for both colliding with the propagating flame front and compressing the mix of fuel and air within the secondary combustion chamber.

A dual piston actuator can also participate in the recycling operations. The dual piston actuator has two concentric sections. The inner concentric section is received in a central bore of a motor housing and the outer concentric section is received in a peripheral annular bore of the motor housing. A downward stroke of the dual piston under compression displaces air from the central bore through a check valve into a plenum and displaces air from the annular bore to an exhaust valve actuator. After the piston reaches the bottom of its stroke, an intake valve is opened to allow air into the central bore. Pressurized air flowing into the peripheral annular bore from the plenum provides for returning the dual piston to the top of its stroke.

As the piston approaches the top of its stroke, a recess within the annular bore forms together with the outer concentric section a control valve that allows air from the plenum to flow into the secondary chamber. From there, the air flows through the unrestricted opening into the primary chamber and out the exhaust valve for scavenging combustion byproducts from both chambers. As air pressure in the plenum drops, the exhaust valve is closed, and fuel is injected into both combustion chambers for replenishing the combustible mix of fuel and air. The free flow of scavenging air through both combustion chambers is enhanced not only by the unrestricted opening between the chambers but also by a tubular form of both chambers that further supports flows through the chambers.

DETAILED DESCRIPTION OF THE INVENTION

Figure 1:
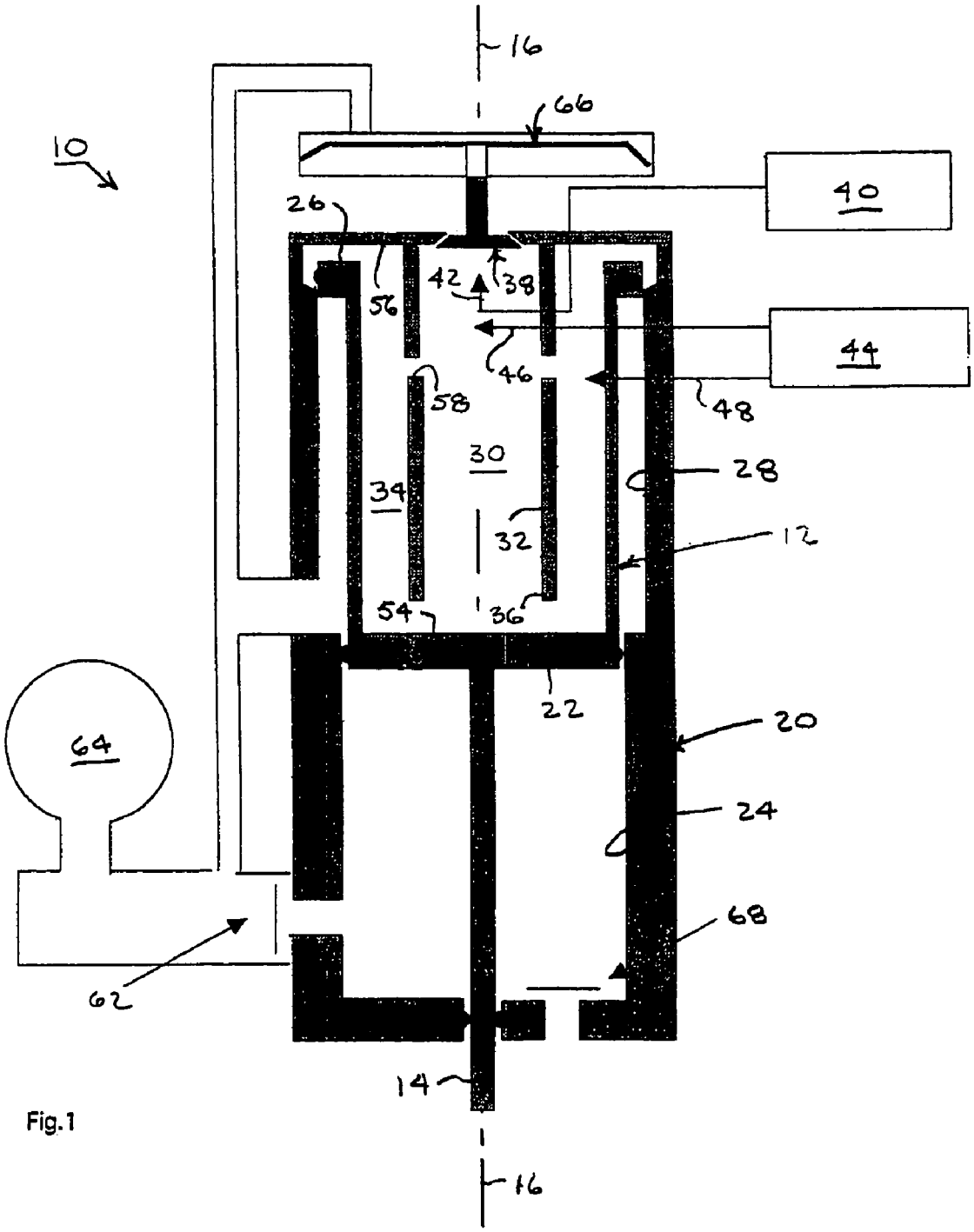
FIG. 1 is a cross-sectional diagram of a spark-ignited combustion powered linear motor arranged in accordance with an embodiment of my invention.

An exemplary spark-ignition combustion-powered linear motor 10 for a portable power tool is shown in progressive stages of operation throughout FIGS. 1–10. The motor 10 has a dual piston actuator 12 with a rod 14 for communicating the power to the portable tool (not shown). The piston actuator 12 is guided along a reference axis 16 within a cylinder housing 20. An inner concentric section 22 of the dual piston actuator 12 is guided within a central bore 24 (i.e., a first bore) of the cylinder housing 20 defining a first air chamber, and an outer concentric section 26 of the dual piston actuator 12 is guided within a peripheral annular bore 28 (i.e., a second bore) of the cylinder housing 20 defining a second air chamber.

A primary combustion chamber 30 occupies a cylindrical space within an open-ended tube 32. A secondary combustion chamber 34 occupies an annular space surrounding the open-ended tube 32. The primary and secondary combustion chambers 30 and 34 are arranged concentrically about the reference axis 16. An unrestricted opening 36 formed at one end of the open-ended tube 32 supports unrestricted flows between the primary and secondary combustion chambers 30 and 34. The substantially uninterrupted tubular wall construction of the primary and secondary combustion chambers 30 and 34 also promotes free flows along and between the primary and secondary combustion chambers 30 and 34. An exhaust valve 38 formed at the other end of the open-ended tube 32 provides for exhausting flows from the primary combustion chamber 30 to atmosphere.

An ignition coil 40 delivers a spark within the primary combustion chamber 30 through an electrode 42. A fuel injector 44 injects fuel into both the primary and secondary combustion chambers 30 and 34 along lines 46 and 48. Fuel is injected in the form of a mist to establish a mix of fuel and air throughout the primary and secondary combustion chambers 30 and 34.

Figure 2:
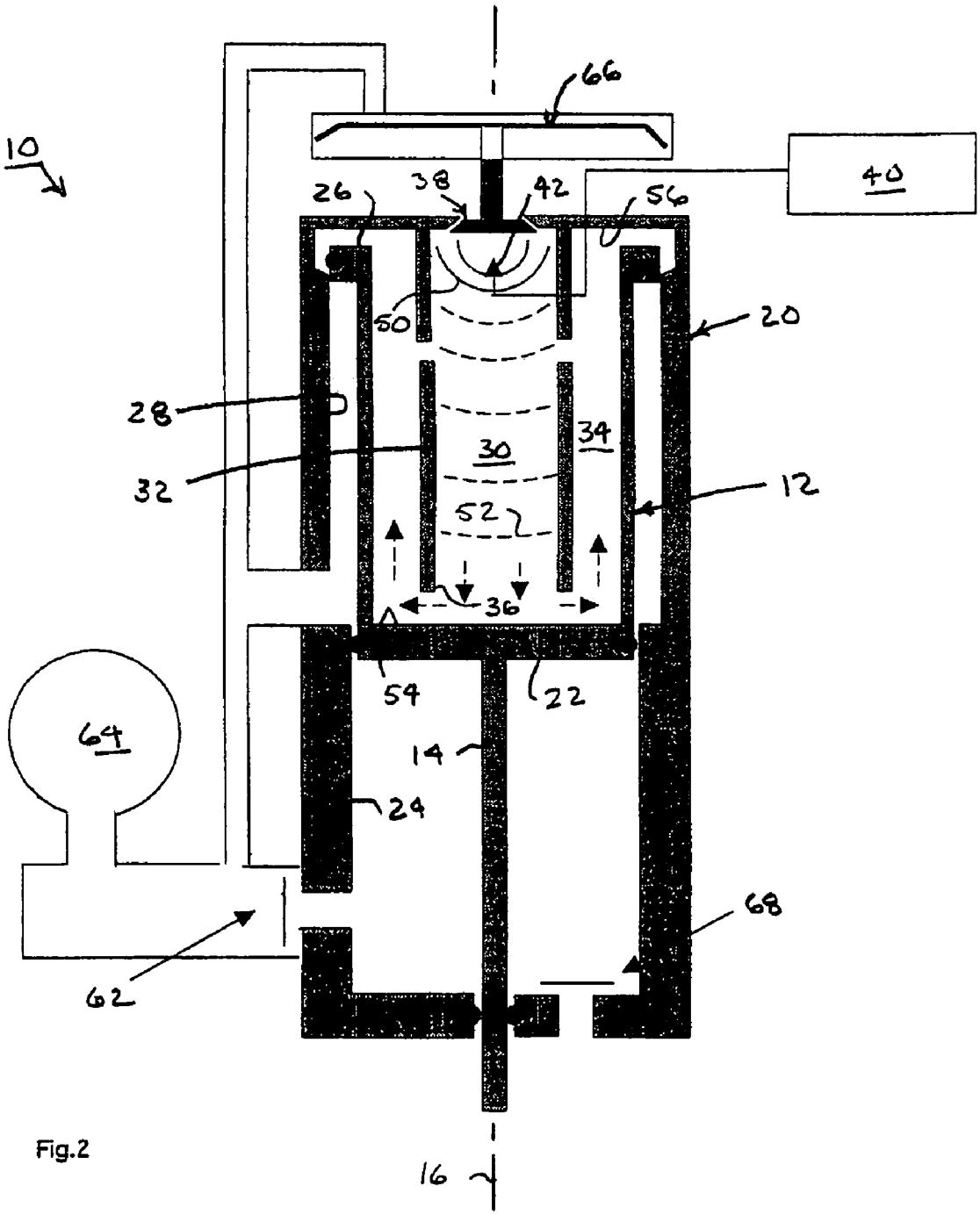
FIG. 2 is a similar view of the same motor showing the generation of a flame front and an accompanying faster compression wave produced by a spark ignition within a primary combustion chamber.

Combustion is initiated in the primary combustion chamber 30 as shown in FIG. 2. A spark produced by the ignition coil 40 ignites a local mixture of fuel and air generating a flame front 50 (shown in arcuate full line) and an accompanying compression wave 52 (shown in arcuate dashed line). Both the flame front 50 and the accompanying compression wave 52 propagate along the reference axis 16 within the primary combustion chamber 30. The flame front 50 advances at a typical rate of about 100 feet per second, and the compression wave 52 advances at a typical rate of about 1000 feet per second (the speed of sound).

Figure 3:
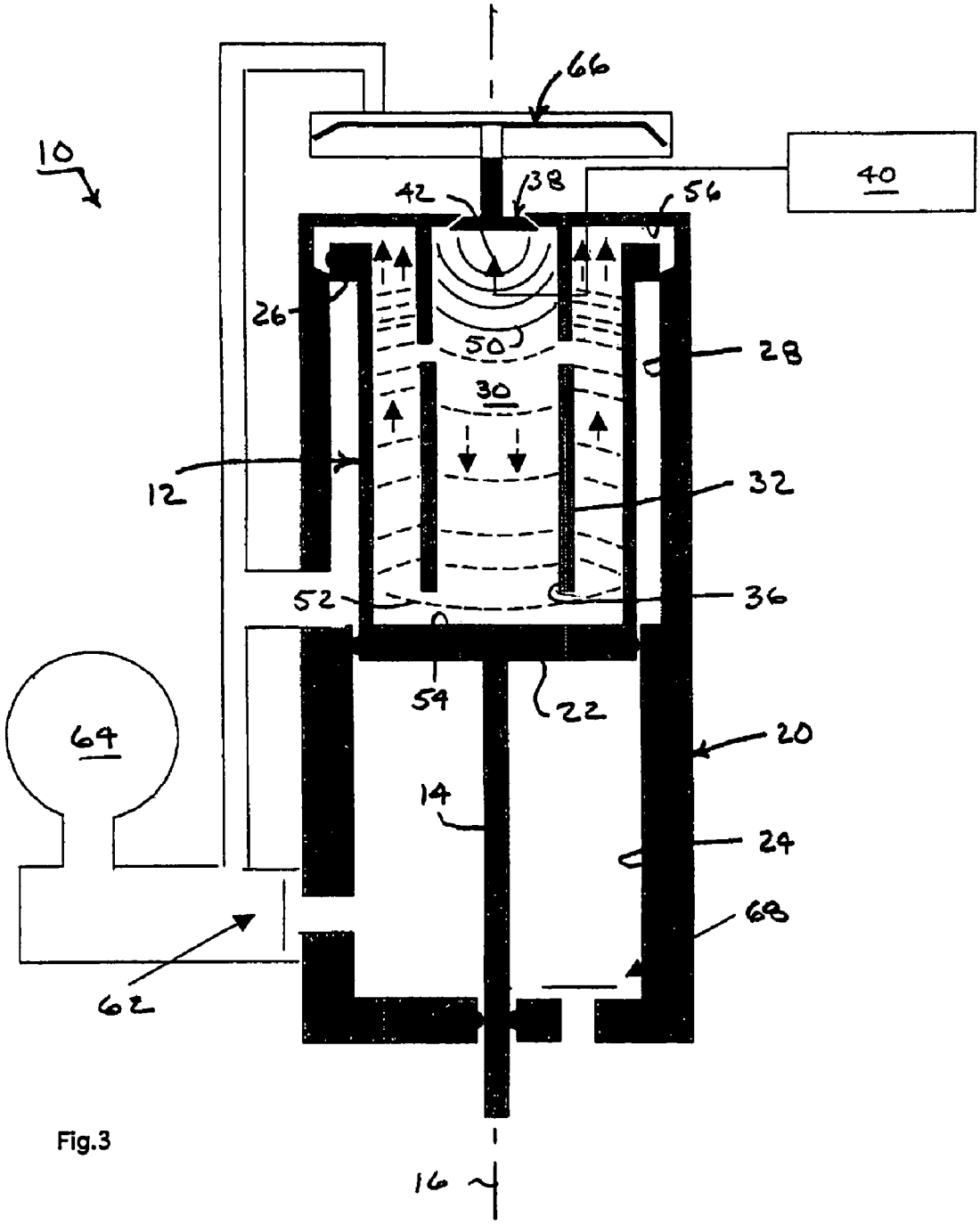
FIG. 3 is a similar view of the same motor showing propagation of the flame front within the primary combustion chamber and the further propagation of the faster compression wave in the secondary combustion chamber.
Figure 4:
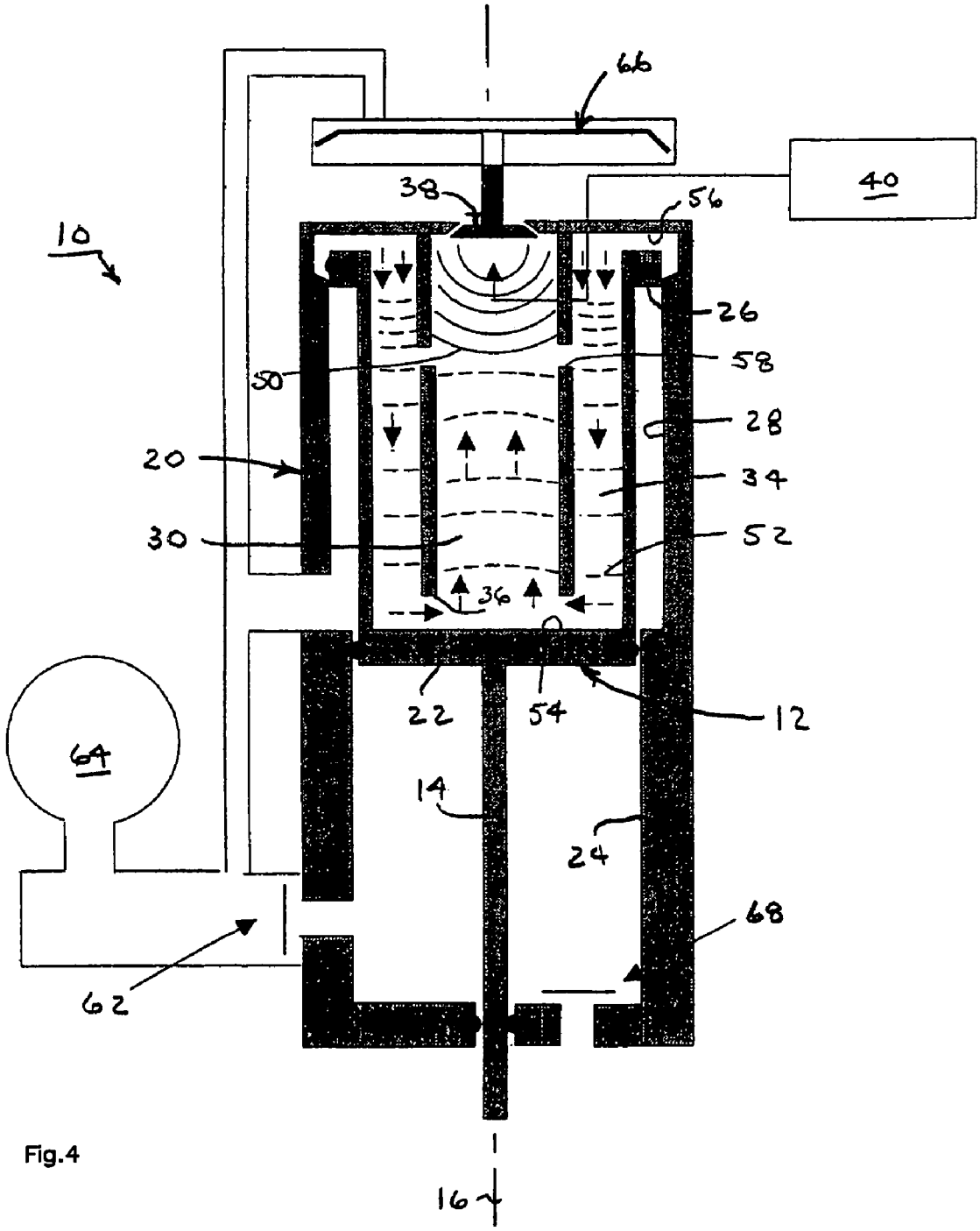
FIG. 4 is a similar view of the same motor showing a reflection of the compression wave.

With reference to FIGS. 3 and 4, the compression wave 52 propagates well in advance of the flame front 50, passing through the unrestricted opening 36 and reflecting between parallel end walls 54 and 56 of the secondary combustion chamber 34. Propagation of the compression wave 52 within the secondary combustion chamber 34 compresses unburned fuel and air approaching the farthest end 56 of the secondary combustion chamber 34. Meanwhile, the slower moving flame front 50 propels an unburned mix of fuel and air in advance of the flame front 50 within the pre-combustion chamber.

Figure 5:
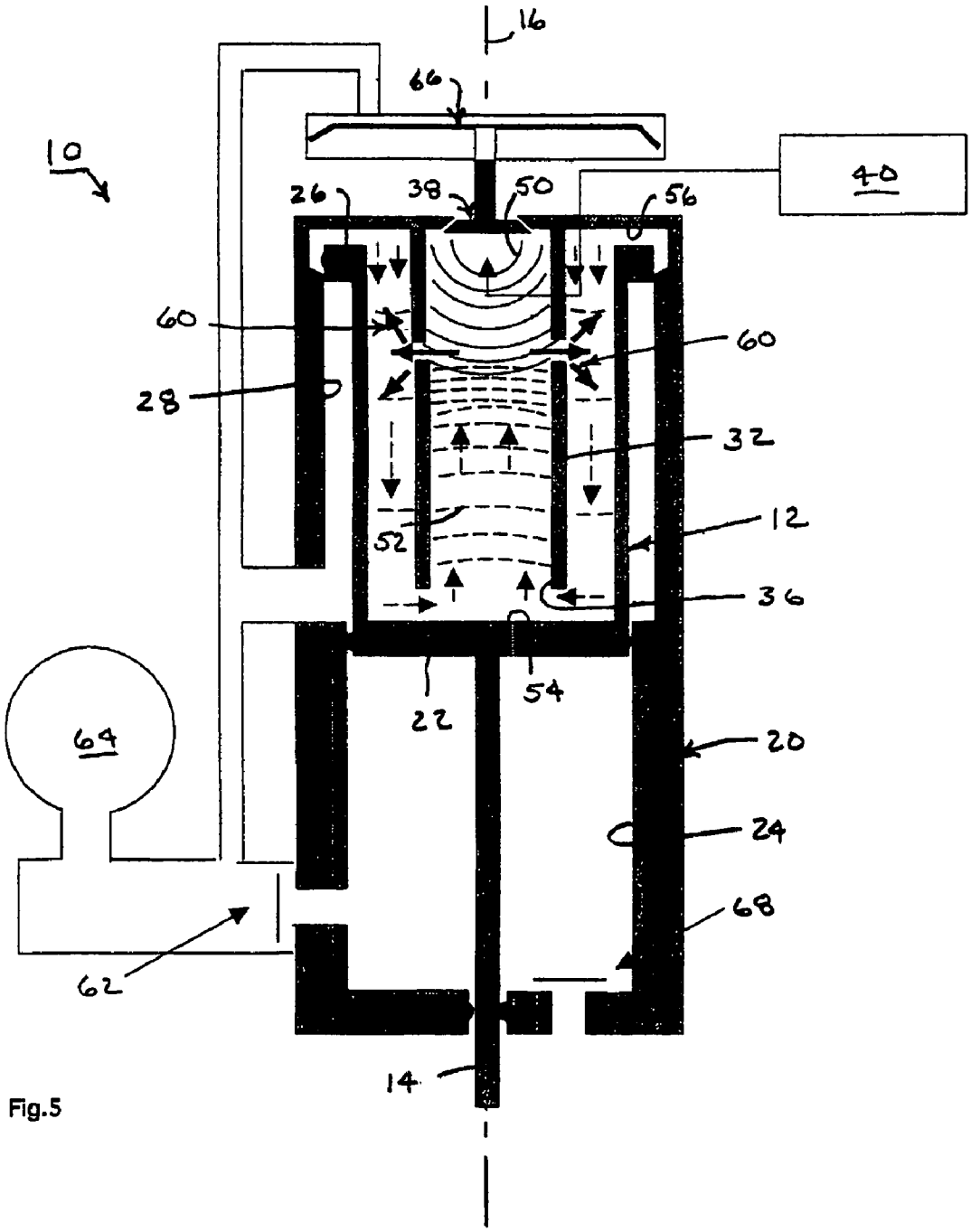
FIG. 5 is a similar view of the same motor showing a collision of the reflected compression wave with the flame front having the effect of forcing flame jets into the secondary combustion chamber.
Figure 6:
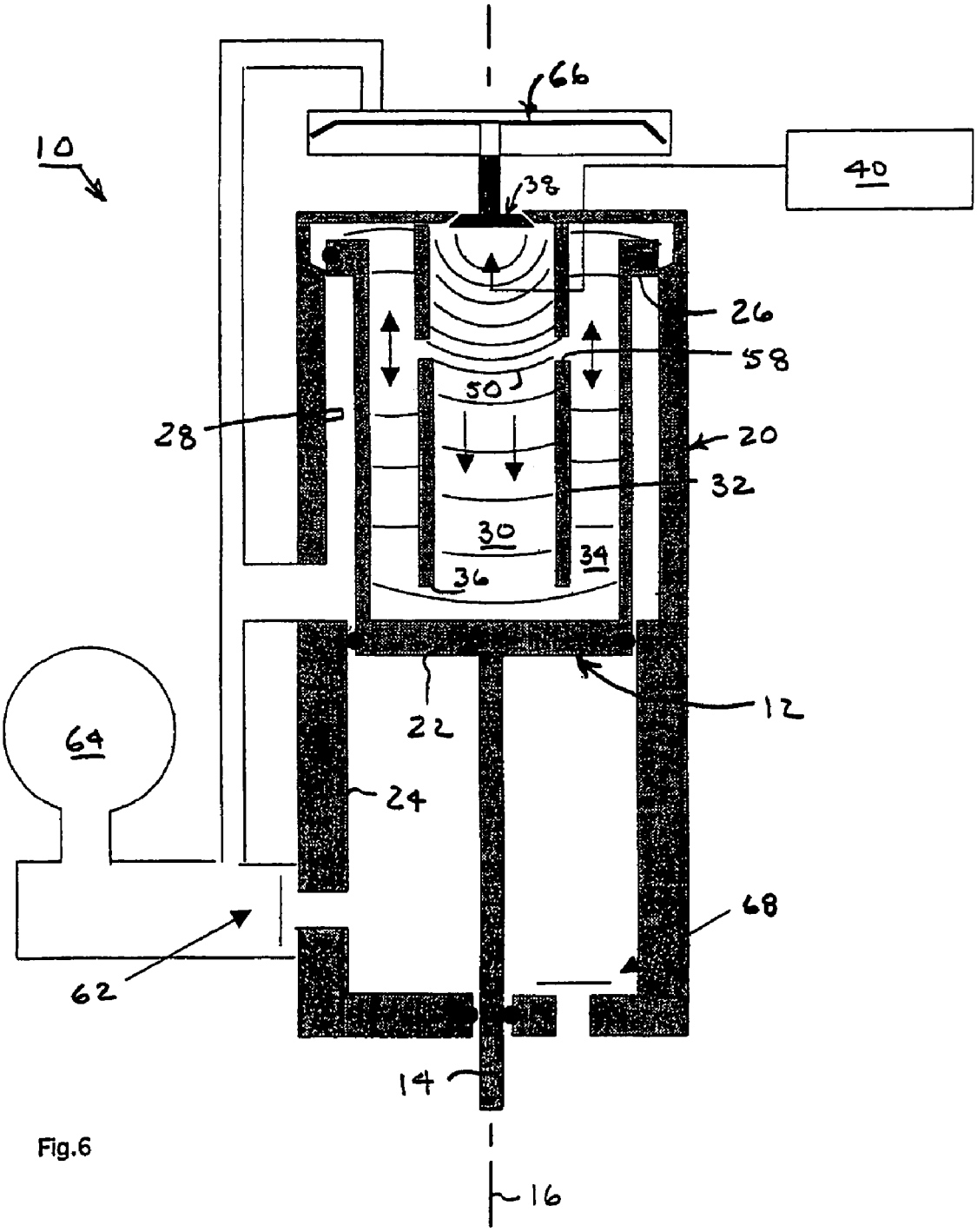
FIG. 6 is a similar view of the same motor showing accelerated combustion within the primary and secondary combustion chambers.

The reflected compression wave 52 returns to the pre-combustion chamber as shown in FIG. 5 and collides with the advancing flame front 50. The collision, which is timed to take place in the vicinity of plurality of small openings 58 through the open-ended tube 32, compresses the unburned fuel and air in advance of the flame front 50 and forces flame jets 60 through the openings 58 into the secondary combustion chamber 34. Preferably, four or more of the openings 58 are distributed radially about the reference axis 16 in a common plane to distribute the flame jets 60 throughout a surrounding region of the secondary combustion chamber 34. The flame jets 60 produce additional turbulence within the remaining mix of fuel and air and accelerate combustion within the secondary combustion chamber, characterized by a more rapid flame propagation rate and pressure against the dual piston actuator 12 as shown in FIG. 6.

Figure 7:
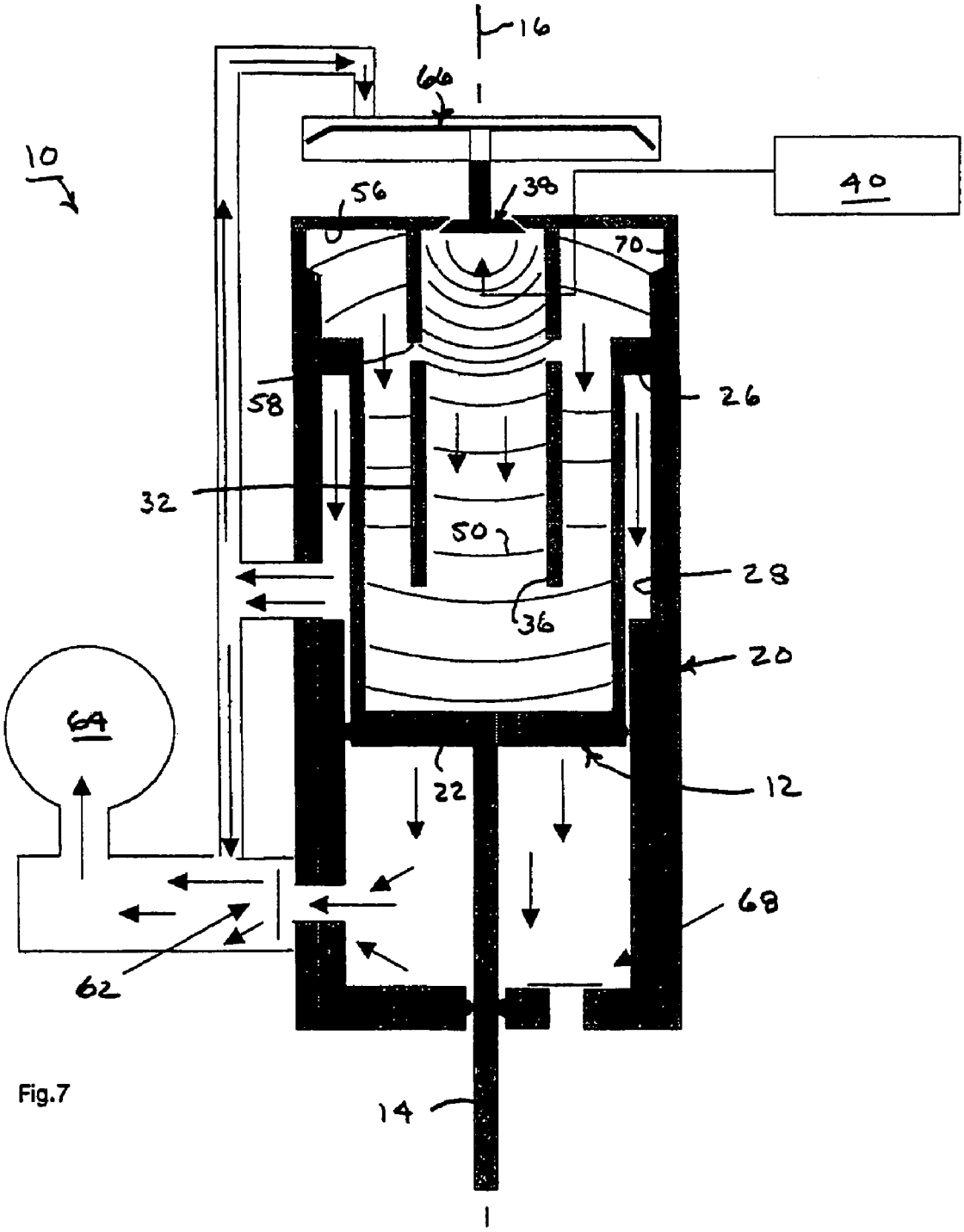
FIG. 7 is a similar view of the same motor showing a displacement of air into a plenum by a dual piston actuator driven by combustion.
Figure 8:
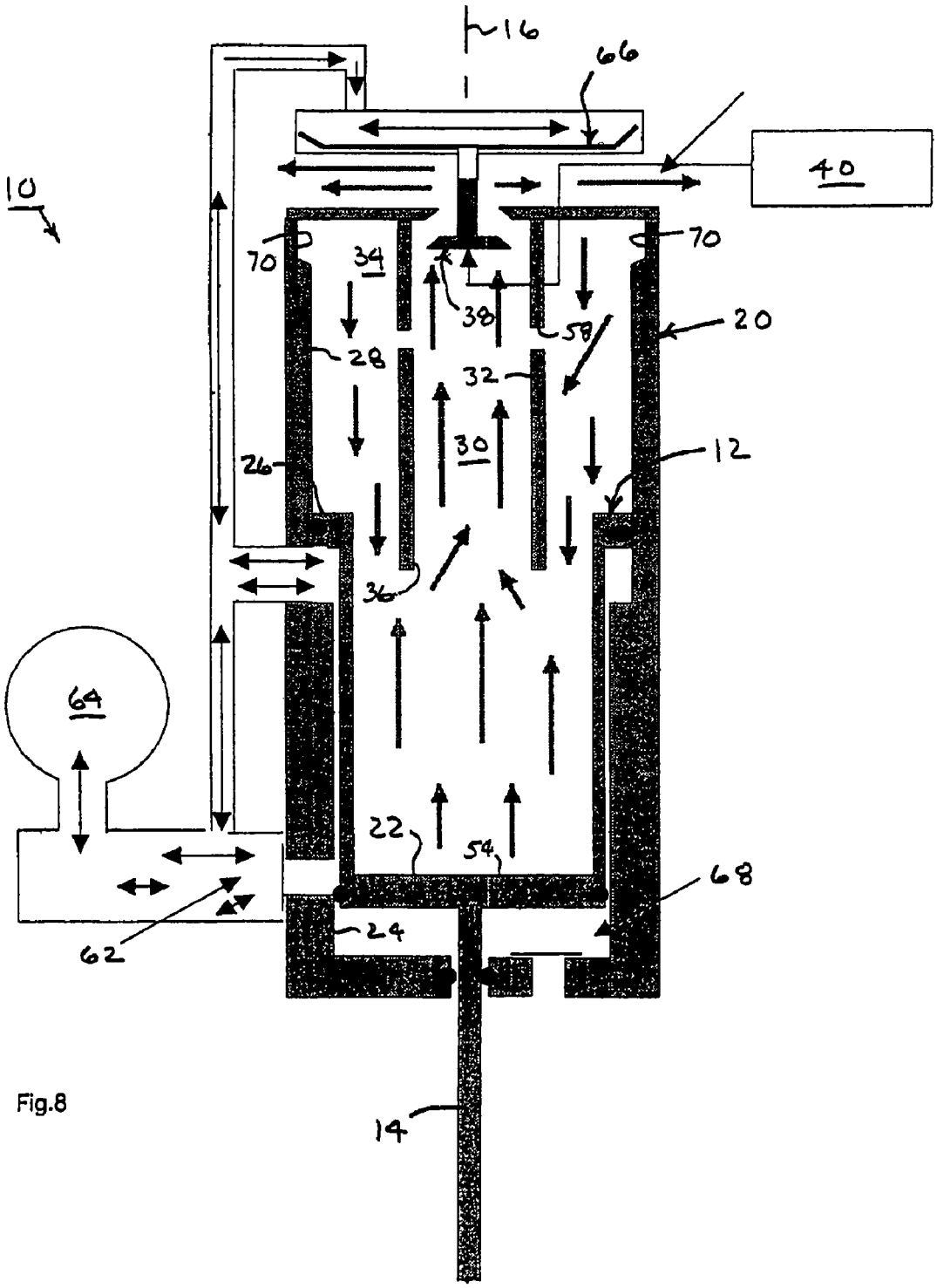
FIG. 8 is a similar view of the same motor showing an exhaust valve opened by airflow from the plenum for exhausting combustion byproducts from the primary and secondary combustion chambers.

As the resulting explosion, as shown by FIG. 7, drives down the piston actuator 12, air within the central bore 24 is pushed through an outlet valve 62 (e.g., a check valve) into a pressurizable plenum 64. Air within the peripheral annular bore 28 is also pushed into the plenum 64, which also communicates with a diaphragm actuator 66 for the exhaust valve 38. Accumulating pressure in the plenum 64 opens the exhaust valve 38 as shown in FIG. 8, which depicts the stroke bottom of the piston actuator 12. Residual combustion pressure is released through the exhaust valve 38 allowing the piston actuator 12 to begin its return toward the top of its stroke.

Figure 9:
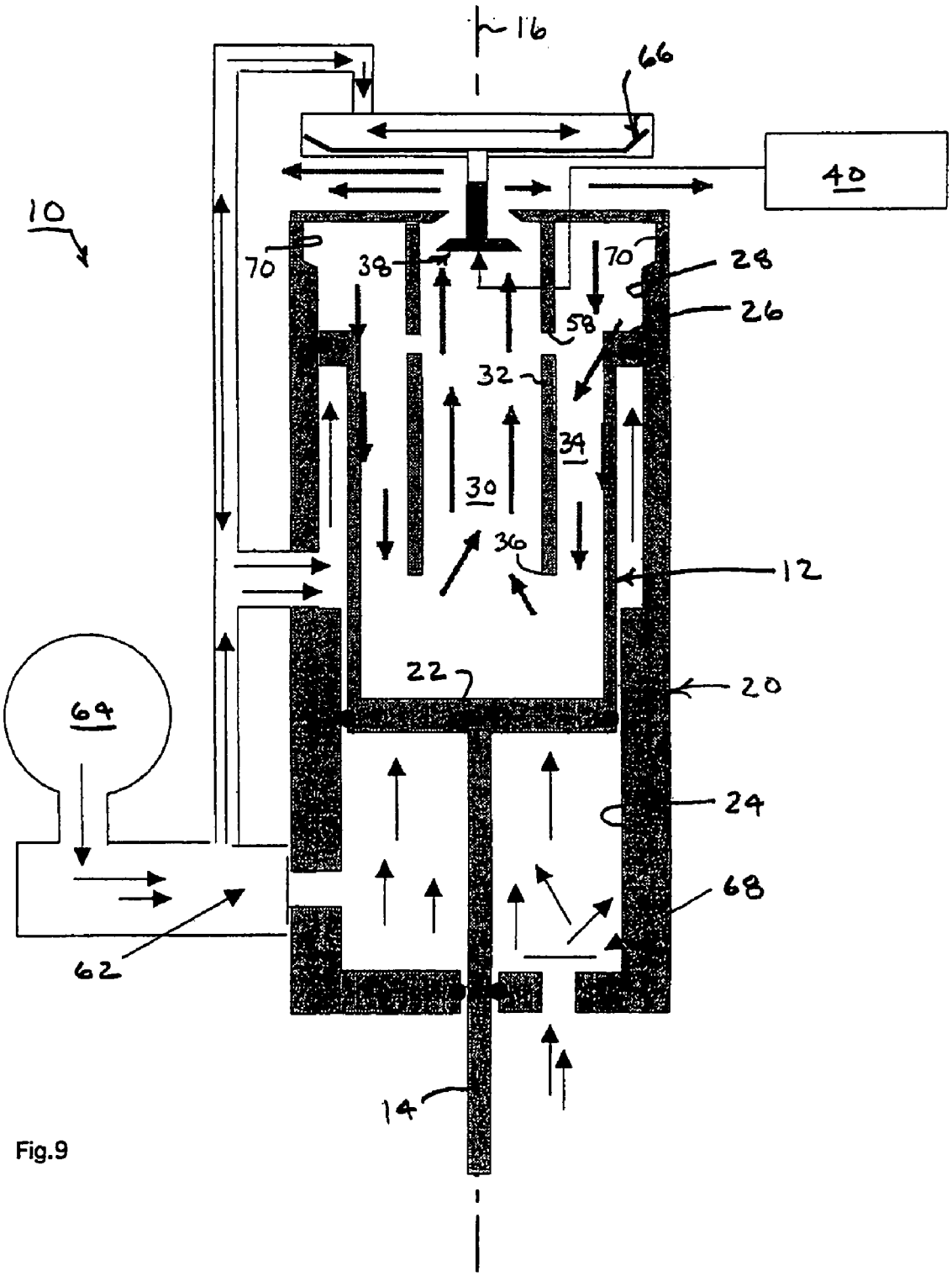
FIG. 9 is a similar view of the same motor showing air pressure from the plenum being used to return the dual piston actuator and an intake valve being opened to allow air to fill space vacated by the returning piston actuator.

The piston actuator 12 is returned, as shown in FIG. 9 by pressurized air from the plenum 64, which is admitted into the peripheral annular bore 28 and which acts against the outer peripheral section 26 of the piston actuator 12. Meanwhile, intake valve 68 (e.g., a check valve) allows air to be replaced within the central bore 24 for occupying the space vacated by the returning piston actuator 12.

Figure 10:
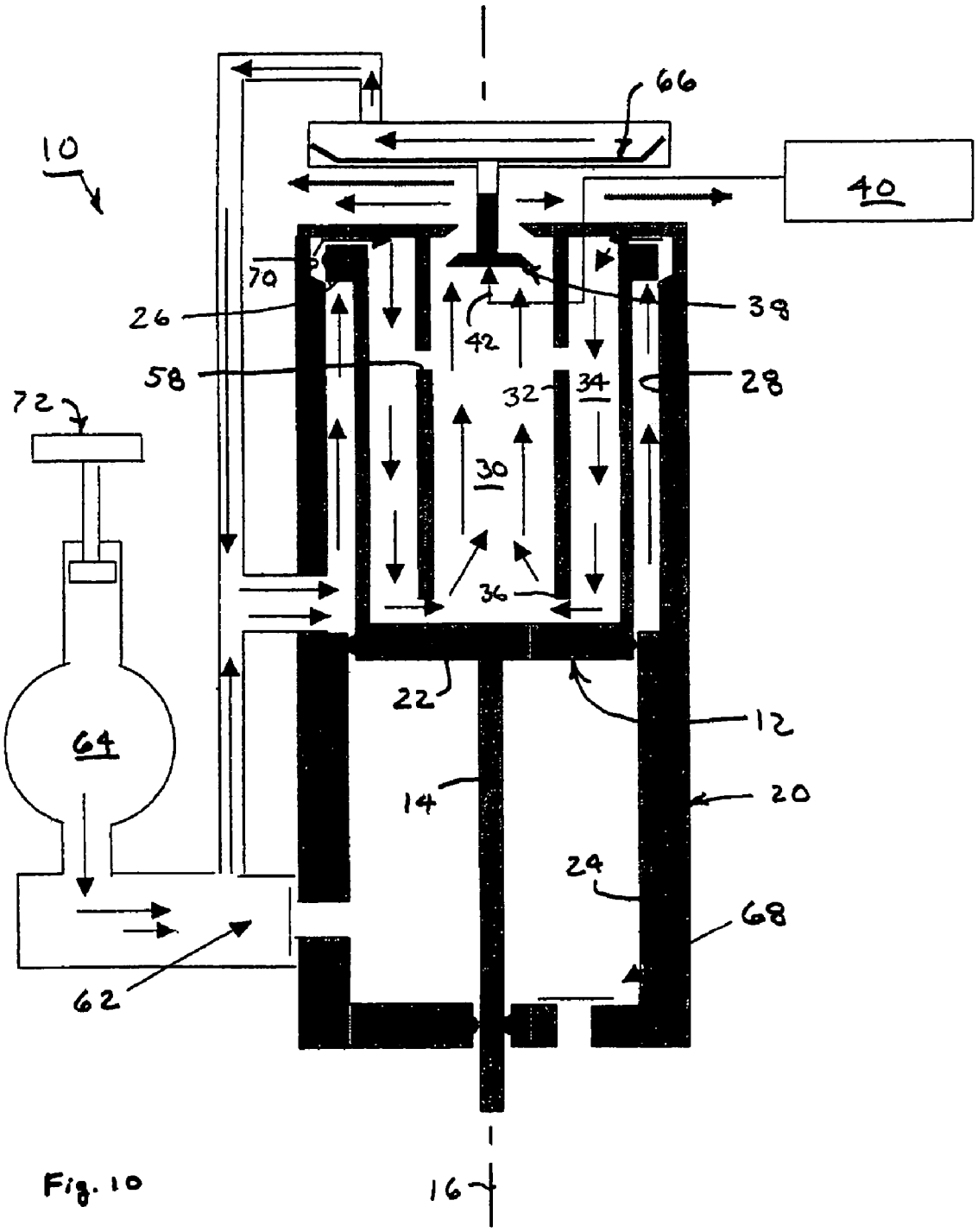
FIG. 10 is a similar view of the same motor showing airflow from the plenum being used to transport combustion byproducts along a substantially uninhibited path from the secondary combustion chamber, through the unrestricted opening, into the primary combustion chamber, and out the exhaust valve.

Near the top of the piston actuator's return stroke, as shown in FIG. 10, its outer peripheral section 26 encounters a recess 70 within the peripheral annular bore 28, which defines a control valve that allows a remaining portion of the compressed air from the plenum 64 to enter the secondary combustion chamber 34. The air entering the secondary combustion chamber 34 performs a scavenging function through both the primary and secondary combustion chambers 30 and 34 for removing combustion byproducts through the exhaust valve 38. Both the unrestricted opening 36 between the primary and secondary combustion chambers 30 and 34 and the largely uninterrupted tubular construction of the primary and secondary combustion chambers 30 and 34 contribute to the efficiency of this scavenging operation.

As the pressure in the plenum 64 decreases further, the exhaust valve 38 closes and the fuel injector 44 injects more fuel into the primary and secondary combustion chambers 30 and 34 to re-establish a combustible mix of fuel and air in preparation for repeating the cycle shown first in FIG. 1. A pump 72, as shown in FIG. 10, can be fitted to the plenum 64 to prime the motor 10 for its first cycle.

Although details of the invention have been set forth in a description of certain preferred embodiments, other variations, especially those attuned to specific applications, will be evident to those of skill in the art in accordance with the overall teaching of the invention. Many applications of the invention are expected for piston-driven tools, but the invention is also applicable to other devices including plunger-driven and other displacement devices.

What is claimed is:

1. A recycling system for linear motors, comprising:

a cylinder housing having a reference axis, a first bore, a second bore, and at least one recess each along the reference axis;

a piston actuator having a first seal guided within the first bore, a second seal guided within the second bore, and a piston body supporting the first and second seals in positions spaced along the reference axis;

a first air chamber within the first bore having a volume bounded by the piston body and the first seal;

a second air chamber within the second bore having a volume bounded by the piston body and the first and second seals;

a combustion chamber within an interior of the piston body having a volume bounded by the piston body and the second seal;

the piston actuator being movable by combustion pressure in a first direction along the reference axis for pumping compressed air from the first air chamber;

the piston actuator being movable by the compressed air in a second direction along the reference axis from a lower position at which the second seal contacts the second bore to a higher position providing a fluid communication path between the combustion chamber and the second air chamber; and the at least one recess being formed as a portion of the combustion chamber defining the fluid communication path and allowing compressed air flow from the second air chamber into the combustion chamber at the higher position of the piston actuator, wherein the second seal together with the second bore and the at least one recess forms a control valve that regulates airflow from the second air chamber into the combustion chamber.

2. The recycling system of claim 1 in which the control valve has a closed position in which the second seal is engaged with the second bore and an open position in which the second seal encounters the at least one recess allowing fluid communication between the combustion chamber and the second air chamber.

3. The recycling system of claim 2 in which the second seal is movable together with the piston actuator along the reference axis from the closed lower position at which the second seal engages the second bore to the open upper position allowing fluid communication between the combustion chamber and the second air chamber.

4. A recycling system for linear motors, comprising:

a cylinder housing having a reference axis, a first bore, a second bore, and at least one recess each along the reference axis, a piston actuator having a first seal guided within the first bore, a second seal guided within the second bore, and a piston body supporting the first and second seals in positions spaced along the reference axis;

a first air chamber within the first bore having a volume bounded by the piston body and the first seal;

a second air chamber within the second bore having a volume bounded by the piston body and the first and second seals;

a combustion chamber within an interior of the piston body having a volume bounded by the piston body and the second seal;

the piston actuator being movable by combustion pressure in a first direction along the reference axis for pumping compressed air from the first air chamber;

the piston actuator being movable by the compressed air in a second direction along the reference axis from a lower position at which the second seal contacts the second bore to a higher position providing a fluid communication path between the combustion chamber and the second air chamber;

the at least one recess being formed as a portion of the combustion chamber defining the fluid communication path and allowing compressed air flow from the second air chamber into the combustion chamber at the higher position of the piston actuator; and an outlet valve that allows air flow from the first air chamber into the second air chamber and restricts air flow from the second air chamber into the first air chamber.

5. A recycling system for linear motors, comprising:

a cylinder housing having a reference axis, a first bore, a second bore, and at least one recess each along the reference axis;

a piston actuator having a first seal guided within the first bore, a second seal guided within the second bore, and a piston body supporting the first and second seals in positions spaced along the reference axis;

a first air chamber within the first bore having a volume bounded by the piston body and the first seal;

a second air chamber within the second bore having a volume bounded by the piston body and the first and second seals;

a combustion chamber within an interior of the piston body having a volume bounded by the piston body and the second seal;

the piston actuator being movable by combustion pressure in a first direction along the reference axis for pumping compressed air from the first air chamber;

the piston actuator being movable by the compressed air in a second direction along the reference axis from a lower position at which the second seal contacts the second bore to a higher position providing a fluid communication path between the combustion chamber and the second air chamber;

the at least one recess being formed as a portion of the combustion chamber defining the fluid communication path and allowing compressed air flow from the second air chamber into the combustion chamber at the higher position of the piston actuator;

a plenum for storing and releasing compressed air;

air passageways connecting the plenum to both the first air chamber and the second air chamber; and an outlet valve that allows passage of compressed air from the first air chamber into the plenum and restricts re-entry of the compressed air from the plenum into the first air chamber.

6. The recycling system of claim 5 further comprising an intake valve that allows entry of air into the first air chamber in response to movement of the piston actuator from the lower position to the higher position and restricts exit of the same air from the first air chamber.

7. The recycling system of claim 1 further comprising an exhaust valve having an open position that allows egress of air from the combustion chamber and a closed position that restricts egress of air from the combustion chamber.

8. The recycling system of claim 7 further comprising an exhaust actuator in fluid communication with at least one of the first air chamber and the second air chamber for opening the exhaust valve.

9. A recycling system for linear motors, comprising:

a cylinder housing having a reference axis, a first bore, a second bore, and at least one recess each along the reference axis;

a piston actuator having a first seal guided within the first bore, a second seal guided within the second bore, and a piston body supporting the first and second seals in positions spaced along the reference axis;

a first air chamber within the first bore having a volume bounded by the piston body and the first seal;

a second air chamber within the second bore having a volume bounded by the piston body and the first and second seals;

a combustion chamber within an interior of the piston body having a volume bounded by the piston body and the second seal;

the piston actuator being movable by combustion pressure in a first direction along the reference axis for pumping compressed air from the first air chamber;

the piston actuator being movable by the compressed air in a second direction along the reference axis from a lower position at which the second seal contacts the second bore to a higher position providing a fluid communication path between the combustion chamber and the second air chamber; and the at least one recess being formed as a portion of the combustion chamber defining the fluid communication path and allowing compressed air flow from the second air chamber into the combustion chamber at the higher position of the piston actuator, wherein the combustion chamber includes:

a primary combustion chamber and a secondary combustion chamber, a first opening between the primary and secondary combustion chambers allowing flows of air between the primary and secondary combustion chambers throughout the movements of the piston actuator in the first and second directions, and a second smaller opening sized to inject flame jets from the primary combustion chamber into the secondary combustion chamber.

10. The recycling system of claim 9 further comprising:

a control valve that regulates air flow from the secondary air chamber into the secondary combustion chamber, and an exhaust valve that regulates air flow from the primary combustion chamber to atmosphere.

11. The recycling system of claim 10 in which the first opening permits a free flow of air from the control valve to the exhaust valve through the secondary and primary combustion chambers.

12. The recycling system of claim 1 in which said at least one recess being a continuous recess extending about an inner surface of the combustion chamber at the higher position of the cylinder.

13. A recycling system for a gas-powered intermittent motor, comprising:

a cylinder housing having top and bottom ends;

a piston actuator having an upper seal and a lower seal within the cylinder housing and being moveable within a cylinder housing;

a combustion chamber occupying a volume within the cylinder housing between the upper seal of the piston actuator and the top end of the cylinder housing;

a first air chamber occupying a volume within the cylinder housing between the lower seal of the piston actuator and the bottom end of the cylinder housing;

a second air chamber having a volume within the cylinder housing between the upper and lower seals of the piston actuator;

portions of the combustion chamber and the second air chamber sharing a common space such that movement of the piston actuator in a downward direction converts a portion of the volume of the second air chamber into a portion of the volume of the combustion chamber and such that an upward movement of the piston actuator opens a control valve disposed between the second air chamber and combustion chamber; and, the control valve having a closed position that restricts airflow from the second air chamber into the combustion chamber and an open position that allows air flow from the second air chamber into the combustion chamber.

14. The recycling system of claim 13 in which the control valve is formed in part by the upper seal of the piston actuator.

15. The recycling system of claim 14 in which the upper seal of the piston actuator separates the combustion chamber from the second air chamber at the closed position of the control valve, and the combustion chamber is joined together with the second air chamber around the upper seal of the piston actuator at the open position of the control valve.

16. The recycling system of claim 15 in which the upper seal contacts the cylinder housing at the closed position of the control valve, and in which at the open position of the control valve a fluid communication path is defined between the second air chamber and the combustion chamber.

17. The recycling system of claim 13 further comprising a plenum that receives compressed air from the first air chamber and releases the compressed air into the combustion chamber through the second air chamber.

18. The recycling system of claim 17 in which the compressed air received by the second air chamber raises the piston actuator to a position that opens the control valve and allows the compressed air to enter the combustion chamber.

19. The recycling system of claim 18 in which both the second air chamber and the first air chamber supply compressed air to the plenum.

20. The recycling system of claim 19 further comprising:

an exhaust valve for venting the combustion chamber, and an exhaust valve actuator exposed to the compressed air for opening the exhaust valve prior to opening the control valve.

21. The recycling system of claim 20 in which the opening of the control valve is delayed with respect to the opening of the exhaust valve by the upward movement of the piston actuator to a position that allows for the opening of the control valve.

22. A method of recycling air within a combustion powered linear motor, comprising steps of:

moving a dual piston within a cylinder housing from an upper position to a lower position by combustion pressure such that a first portion of the piston pumps compressed air from a first air chamber within a first bore of the cylinder housing and a second portion of the piston pumps compressed air from a second air chamber within a second larger bore of the cylinder housing;

opening an exhaust valve by the compressed air for venting the combustion chamber to atmosphere;

moving the dual piston within the cylinder housing from the lower position to the upper position assisted by the compressed air such that the dual piston is disposed adjacent at least one recess defining a control valve; and opening the control valve to define a fluid communication path between the combustion chamber and the second air chamber in response to movement of the dual piston to the upper position for allowing airflow from the second air chamber into the combustion chamber.

23. The method of claim 22 in which the exhaust valve remains open for venting the air flow from the second air chamber through the combustion chamber to atmosphere until a biasing force for closing the exhaust valve overcomes a force generated by the compressed air for opening the exhaust valve.

24. The method of claim 23 including a further step of storing the compressed air pumped from the first air chamber in a plenum and directing a flow of compressed air from the plenum to the second air chamber during the movement of the piston from its lower to upper position.

25. A recycler system for linear motors, comprising:

a cylinder housing having a reference axis extending between a top end and a bottom end;

the cylinder housing also having a first bore, a second bore, and a recess all spaced apart along the reference axis;

a piston actuator having a first seal and a second seal within the cylinder housing in spaced positions along the reference axis;

a first air chamber occupying a volume within the cylinder housing between the first seal of the piston actuator and the bottom end of the cylinder housing;

a second air chamber having a volume within the cylinder housing between the first and second seals of the piston actuator;

the piston actuator being movable from a first position at which the second seal contacts the second bore to a second position at which the seal encounters the recess providing a fluid communication path between a combustion chamber and the second air chamber;

the recess being formed as a portion of the combustion chamber defining the fluid communication path allowing compressed air flow from the second air chamber into the combustion chamber at the second position of the actuator.

26. A recycling system for a gas-powered intermittent motor, comprising:

a cylinder housing having a reference axis extending between a first end and a second end;

a first bore and a second bore formed in a spaced relationship along the reference axis of the cylinder housing;

a piston actuator disposed within said cylinder housing having a first seal spaced apart from a second seal in the direction of the reference axis;

a combustion chamber occupying a volume with the cylinder housing between the second end of the cylinder housing and the second seal of the piston actuator;

a first air chamber occupying a volume within the first bore between the first seal of the piston actuator and the first end of the cylinder housing;

a second air chamber occupying a volume within the second bore between the first seal and the second seal of the piston actuator;

a control valve defining a fluid communication path between the second air chamber and the combustion chamber.

* * * * *